US009334103B2

(12) United States Patent
Soliman

(10) Patent No.: US 9,334,103 B2
(45) **Date of Patent: *May 10, 2016**

(54) PLASTIC AEROSOL CONTAINER

(71) Applicant: Atef Gabr Soliman, Cairo (EG)

(72) Inventor: Atef Gabr Soliman, Cairo (EG)

( * ) Notice: Subject to any disclaimer, the term of this patent is extended or adjusted under 35 U.S.C. 154(b) by 0 days.

This patent is subject to a terminal disclaimer.

(21) Appl. No.: 14/626,578

(22) Filed: Feb. 19, 2015

(65) Prior Publication Data

US 2015/0158660 A1 Jun. 11, 2015

Related U.S. Application Data

(63) Continuation of application No. 12/897,049, filed on Oct. 4, 2010, now Pat. No. 8,960,503.

(60) Provisional application No. 61/278,325, filed on Oct. 5, 2009.

(51) Int. Cl.

| | |
|---|---|
| ***B65D 83/00*** | (2006.01) |
| ***B65D 83/38*** | (2006.01) |
| ***B65D 1/02*** | (2006.01) |
| *B65D 83/48* | (2006.01) |
| *B65D 83/40* | (2006.01) |

(52) U.S. Cl.

CPC ..... *B65D 83/38* (2013.01); *B65D 1/023* (2013.01); *B65D 1/0284* (2013.01); *B65D 83/40* (2013.01); *B65D 83/48* (2013.01)

(58) Field of Classification Search

CPC ..... B65D 83/38; B65D 83/40; B65D 83/48; B65D 1/023; B65D 1/0824

See application file for complete search history.

(56) References Cited

U.S. PATENT DOCUMENTS

| | | | | | |
|---|---|---|---|---|---|
| 3,272,390 | A | | 9/1966 | Horwitt | |
| 3,306,497 | A | | 2/1967 | Allen et al. | |
| D208,886 | S | * | 10/1967 | Vuillemenot | D9/448 |
| D228,547 | S | * | 10/1973 | Grothoff | D9/448 |
| 4,065,036 | A | | 12/1977 | Kirk, Jr. | |
| 4,093,123 | A | * | 6/1978 | Maran | 239/322 |
| D255,012 | S | * | 5/1980 | Ostrowsky | D9/448 |
| 4,261,473 | A | * | 4/1981 | Yamada et al. | 215/379 |
| 5,038,952 | A | * | 8/1991 | Dorfman | 215/324 |
| 5,454,481 | A | * | 10/1995 | Hsu | 220/608 |
| 5,553,753 | A | * | 9/1996 | Abplanalp | 222/387 |
| 5,586,695 | A | * | 12/1996 | Labus et al. | 222/396 |
| 5,906,286 | A | * | 5/1999 | Matsuno et al. | 215/375 |

(Continued)

FOREIGN PATENT DOCUMENTS

EG 20060120655 1/2011

OTHER PUBLICATIONS

British Standard, "Specification for Non-refillable plastics aerosol dispensers up to 1000 ml capacity," BS 5597: 1991.

(Continued)

*Primary Examiner* — Frederick C Nicolas
(74) *Attorney, Agent, or Firm* — Ballard Spahr LLP

(57) ABSTRACT

A plastic aerosol container having a neck, a support ring, a shoulder, a cylindrical body, a base, a dispensing valve and a cap. The neck further includes a lip and a lip cavity. The support ring protrudes below the lip cavity and above the shoulder. The shoulder supports the neck and aides in preventing deformation of the container. The base further includes legs. The dispensing valve is placed atop the neck and sealed thereto. The cap is placed atop the valve and functions as an actuator to release the contents of the can.

24 Claims, 10 Drawing Sheets

(56) References Cited

U.S. PATENT DOCUMENTS

| | | | | |
|---|---|---|---|---|
| 6,089,410 | A * | 7/2000 | Ponton | 222/183 |
| 6,296,156 | B1 * | 10/2001 | Lasserre et al. | 222/402.1 |
| 6,390,326 | B1 * | 5/2002 | Hung | 220/616 |
| 6,484,900 | B1 * | 11/2002 | Stiner et al. | 220/662 |
| D482,623 | S * | 11/2003 | Martin | D9/538 |
| D510,031 | S * | 9/2005 | Slat et al. | D9/553 |
| D519,384 | S * | 4/2006 | Voss et al. | D9/668 |
| 7,028,866 | B2 * | 4/2006 | Kunesh et al. | 222/402.1 |
| D543,462 | S * | 5/2007 | Pedmo et al. | D9/520 |
| 7,303,087 | B2 * | 12/2007 | Flashinski et al. | 215/42 |
| D565,961 | S * | 4/2008 | Dellevigne | D9/550 |
| D574,252 | S * | 8/2008 | Ryan et al. | D9/600 |
| 7,448,517 | B2 * | 11/2008 | Shieh et al. | 222/394 |
| 7,540,397 | B2 * | 6/2009 | Muderlak et al. | 222/400.5 |
| 7,708,171 | B2 * | 5/2010 | Regan et al. | 222/389 |
| 7,824,750 | B2 * | 11/2010 | Takegoshi et al. | 428/35.7 |
| D655,619 | S | 3/2012 | Soliman | |
| 8,960,503 | B2 * | 2/2015 | Soliman | 222/402.1 |
| 2002/0020721 | A1 * | 2/2002 | Bonningue et al. | 222/402.1 |
| 2002/0033394 | A1 * | 3/2002 | Towfighi | 220/89.2 |
| 2002/0148800 | A1 * | 10/2002 | Ozawa et al. | 215/40 |
| 2003/0080158 | A1 * | 5/2003 | Cull | 222/397 |
| 2004/0050874 | A1 * | 3/2004 | Blanchester | 222/331 |
| 2007/0145079 | A1 * | 6/2007 | Casamento et al. | 222/386.5 |
| 2007/0245538 | A1 * | 10/2007 | Salameh | 29/453 |
| 2009/0169786 | A1 * | 7/2009 | Dierick | 428/36.8 |
| 2009/0176683 | A1 * | 7/2009 | Choe et al. | 510/378 |
| 2011/0017701 | A1 | 1/2011 | Soliman | |

OTHER PUBLICATIONS

Mark's Standard Handbook for Mechanical Engineers (1996), Section 5 Strength of Materials, 5-8 Fatigue, 5-45 Cylinders and; Spheres (3 pages).

Notice of Allowance and Fees Due issued by the U.S. Patent & Trademark Office on Sep. 2, 2015 for U.S. Appl. No. 29/387,508, filed Mar. 14, 2011 and issued as U.S. Design Patent No. D655619 on Mar. 13, 2014 (Inventor—Soliman // Applicant—Home Care Egypt) (8 pages).

Non-Final Office Action issued by the U.S. Patent & Trademark Office on Sep. 11, 2012 for U.S. Appl. No. 12/897,049, filed Oct. 4, 2010 and issued as U.S. Pat. No. 8,960,503 on Feb. 24, 2015 (Inventor—Soliman // Applicant—Home Care Egypt) (11 pages).

Response to Non-Final Office Action filed on Dec. 10, 2012 for U.S. Appl. No. 12/897,049, filed Oct. 4, 2010 and issued as U.S. Pat. No. 8,960,503 on Feb. 24, 2015 (Inventor—Soliman // Applicant—Home Care Egypt) (11 pages).

Final Office Action issued by the U.S. Patent & Trademark Office on Sep. 5, 2013 for U.S. Appl. No. 12/897,049, filed Oct. 4, 2010 and issued as U.S. Pat. No. 8,960,503 on Feb. 24, 2015 (Inventor—Soliman // Applicant—Home Care Egypt) (16 pages).

Response to Final Office Action filed on Apr. 5, 2013 for U.S. Appl. No. 12/897,049, filed Oct. 4, 2010 and issued as U.S. Pat. No. 8,960,503 on Feb. 24, 2015 (Inventor—Soliman // Applicant—Home Care Egypt) (11 pages).

Non-Final Office Action issued by the U.S. Patent & Trademark Office on Sep. 12, 2013 for U.S. Appl. No. 12/897,049, filed Oct. 4, 2010 and issued as U.S. Pat. No. 8,960,503 on Feb. 24, 2015 (Inventor—Soliman // Applicant—Home Care Egypt) (8 pages).

Response to Non-Final Office Action filed on Mar. 12, 2014 for U.S. Appl. No. 12/897,049, filed Oct. 4, 2010 and issued as U.S. Pat. No. 8,960,503 on Feb. 24, 2015 (Inventor—Soliman // Applicant—Home Care Egypt) (13 pages).

Final Office Action issued by the U.S. Patent & Trademark Office on May 22, 2014 for U.S. Appl. No. 12/897,049, filed Oct. 4, 2010 and issued as U.S. Pat. No. 8,960,503 on Feb. 24, 2015 (Inventor—Soliman // Applicant—Home Care Egypt) (9 pages).

Response to Final Office Action filed on Nov. 24, 2014 for U.S. Appl. No. 12/897,049, filed Oct. 4, 2010 and issued as U.S. Pat. No. 8,960,503 on Feb. 24, 2015 (Inventor—Soliman // Applicant—Home Care Egypt) (14 pages).

Notice of Allowance and Fees Due issued by the U.S. Patent & Trademark Office on Dec. 5, 2014 for U.S. Appl. No. 12/897,049, filed Oct. 4, 2010 and issued as U.S. Pat. No. 8,960,503 on Feb. 24, 2015 (Inventor—Soliman // Applicant—Home Care Egypt) (7 pages).

Non-Final Office Action issued by the U.S. Patent & Trademark Office on Jul. 21, 2010 for U.S. Appl. No. 29/347,353, filed Mar. 25, 2010 (Inventor—Soliman // Applicant—Home Care Egypt (6 pages).

Response to Non-Final Office Action filed on Mar. 25, 2010 for U.S. Appl. No. 29/347,353, filed Mar. 25, 2010 (Inventor—Soliman // Applicant—Home Care Egypt) (7 pages).

Final Office Action issued by the U.S. Patent & Trademark Office on Dec. 14, 2010 for U.S. Appl. No. 29/347,353, filed Mar. 25, 2010 (Inventor—Soliman // Applicant—Home Care Egypt) (6 pages).

* cited by examiner

PLASTIC AEROSOL CONTAINER

CROSS REFERENCE TO RELATED APPLICATIONS

This application is a continuation of U.S. application Ser. No. 12/897,049, filed Oct. 4, 2010, which claims priority to provisional Application No. 61/278,325, filed on Oct. 5, 2009. The disclosures of each of the above-referenced applications are hereby incorporated herein by reference in their entirety.

FIELD

This application relates to containers, specifically containers used for dispensing a pressurized product.

BACKGROUND

Presently, aerosol containers are made of a metal, generally either steel or aluminum. The cost of these materials has increased significantly, causing an increase in the cost of manufacturing aerosol containers.

Containers made of metal are considered to be a safety hazard. Particularly in the case of aerosol containers, there is a risk of explosion when exposed to heat or electricity. This danger is generally due to the high pressure that exists within the container and the highly flammable nature of the container contents.

Metal containers are also prone to leaving metal oxide deposits on all types of surfaces.

It has long been thought that plastics are not strong enough to resist the high pressure caused by the propellants used in aerosols.

Further, high pressure has been known to cause the plastic to creep, especially near the top and bottom of a container.

High pressure within a container may cause the configuration of the base to be altered. For example, the pressure can cause the base of the container to extend or balloon outward. If the configuration of the base changes, the container may no longer be suitable for standing upward on a substantially flat surface.

Further, there is risk that plastic will react with the chemicals of the solution in the container.

Accordingly, there is a need for a plastic aerosol container that is safer, lighter weight, less expensive to manufacture, and able to resist pressure as well as or better than the traditional types of aerosol can. The present invention addresses one or more of these needs.

SUMMARY

A plastic aerosol container comprising a neck, a support ring, a shoulder, a cylindrical body, a base, a dispensing valve and a cap. The neck further includes a lip and a lip cavity. The support ring protrudes below the lip cavity and above the shoulder. The shoulder supports the neck and aides in preventing deformation of the container. The base further includes legs. The dispensing valve is placed atop the neck and sealed thereto. The cap is placed atop the valve and functions as an actuator to release the contents of the can.

Other independent features and advantages of the plastic aerosol container will become apparent from the following detailed description, taken in conjunction with the accompanying drawings which illustrate, by way of example, the principles of the invention.

DESCRIPTION

The following detailed description of the invention is merely exemplary in nature and is not intended to limit the invention or the application and uses of the invention. Furthermore, there is no intention to be bound by any theory presented in the preceding Background or Summary or the following Description. Reference will now be made to exemplary embodiments, examples of which are illustrated in the accompanying drawings.

Figure 1:
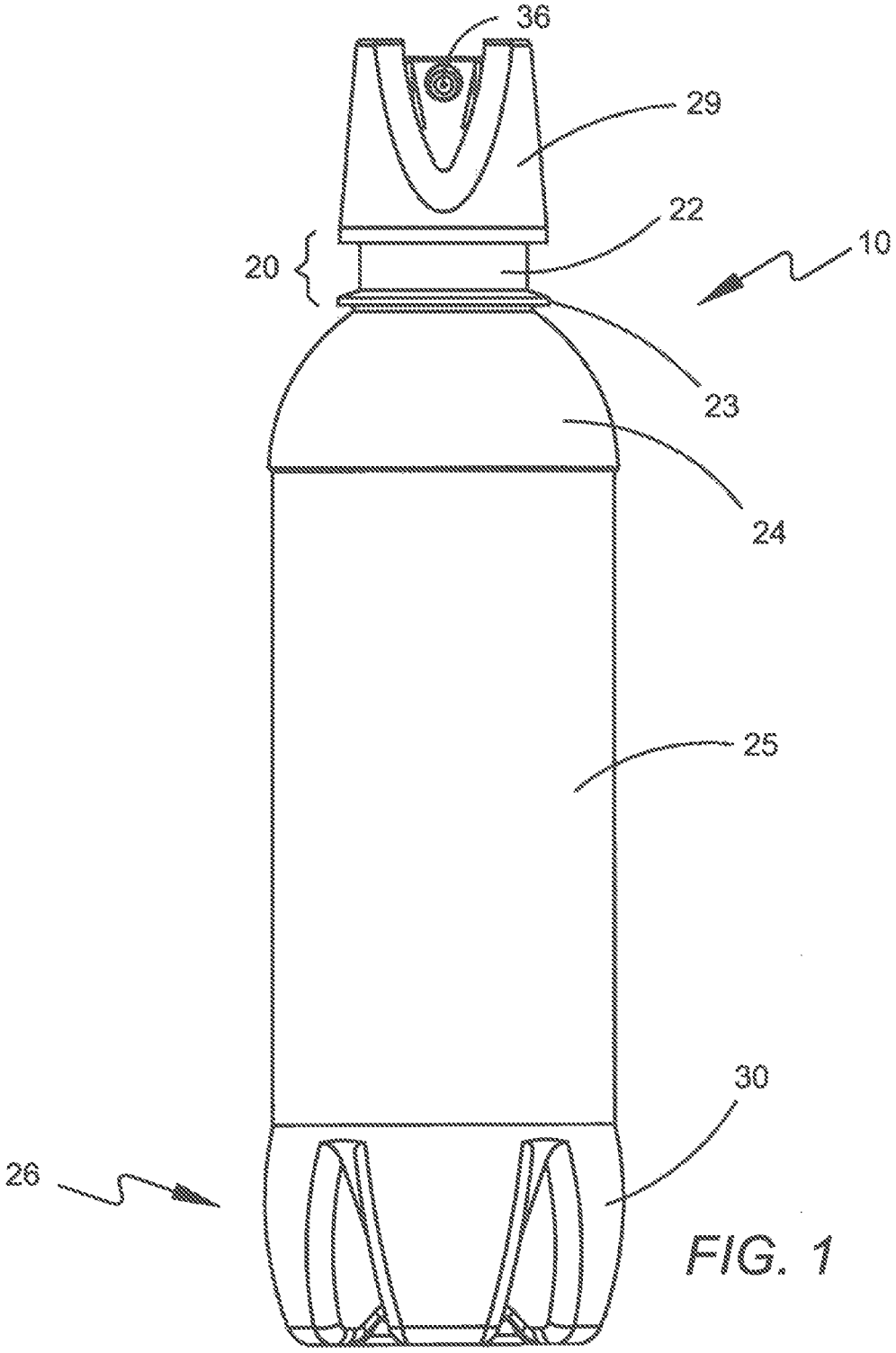
FIG. 1 is a front view of a plastic aerosol container, according to an embodiment of the invention.
Figure 2:
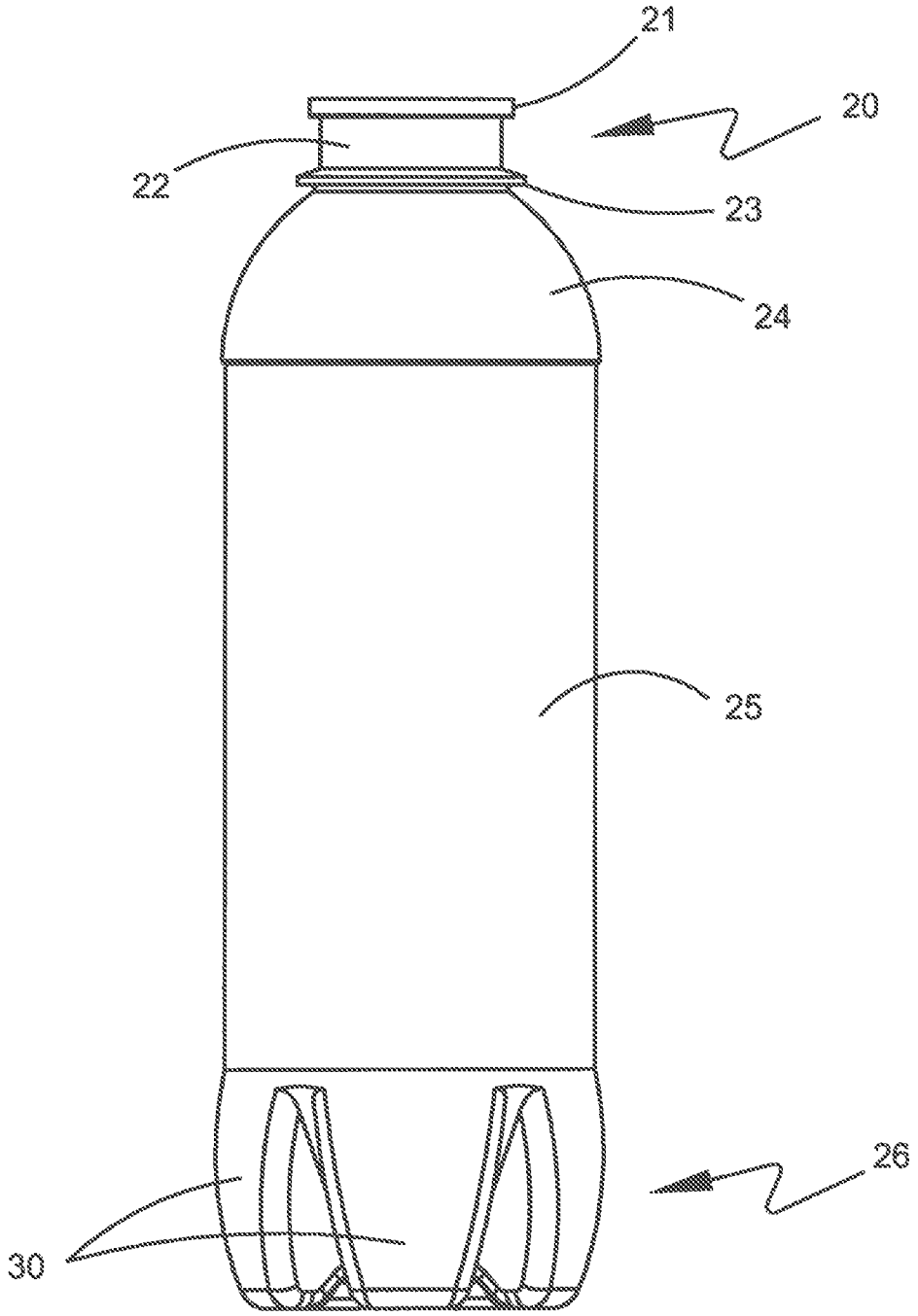
FIG. 2 is a front view of a plastic aerosol container shown separated from the cap, according to an embodiment of the invention.
Figure 4:
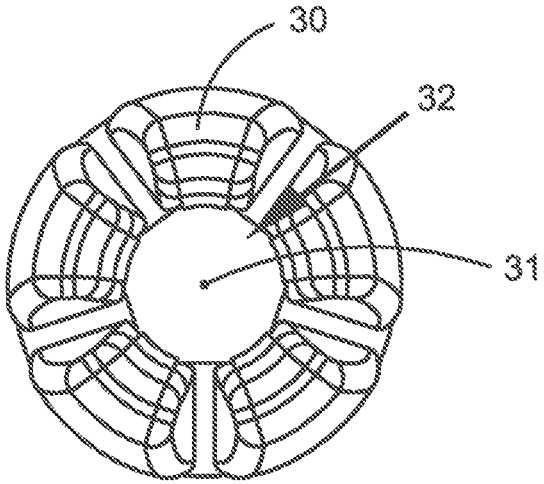
FIG. 4 is a bottom view of a plastic aerosol container, according to an embodiment of the invention.
Figure 5:
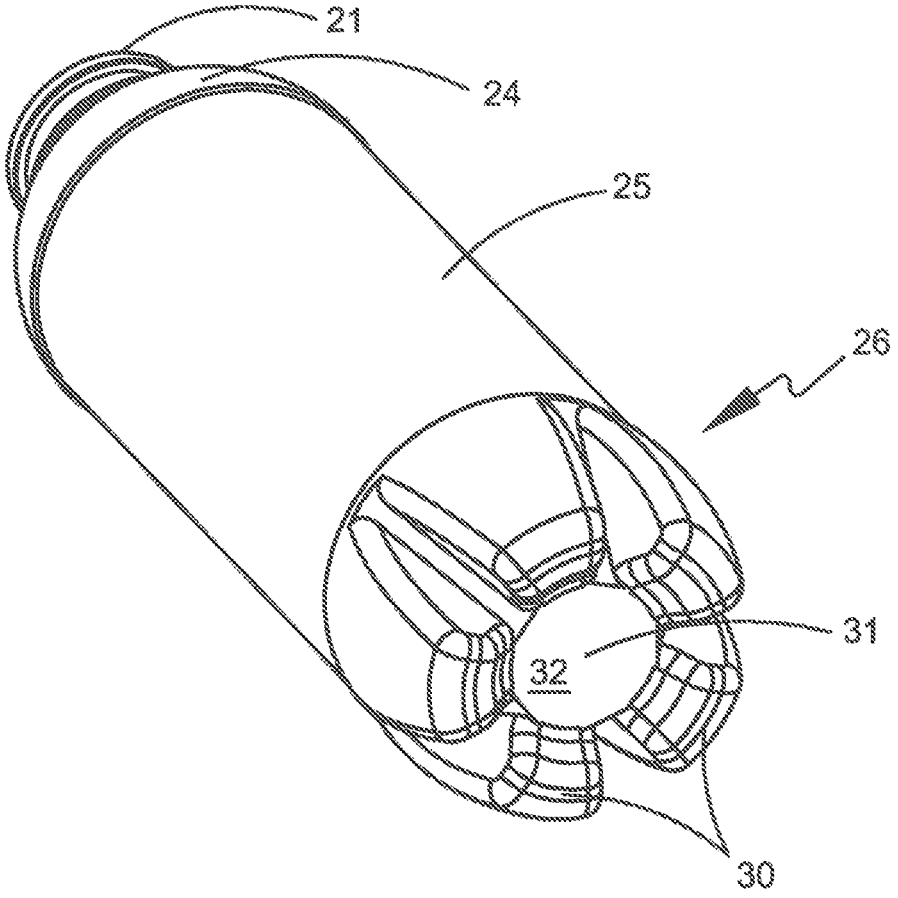
FIG. 5 is a bottom perspective view of a plastic aerosol container, shown separated from the cap, according to an embodiment of the invention.
Figure 8:
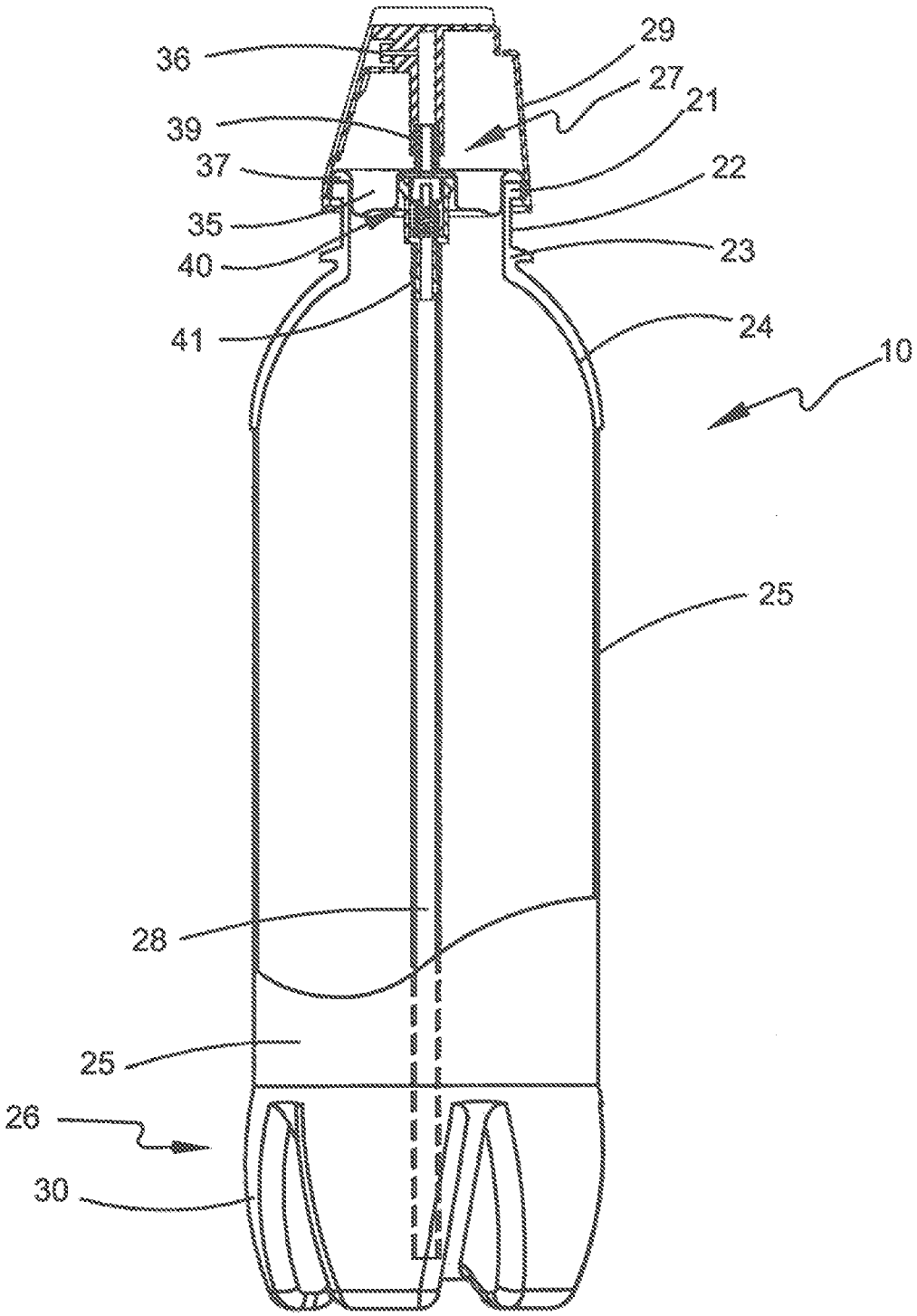
FIG. 8 is a partial cross-sectional view of a plastic aerosol container, according to an embodiment of the invention.
Figure 9:
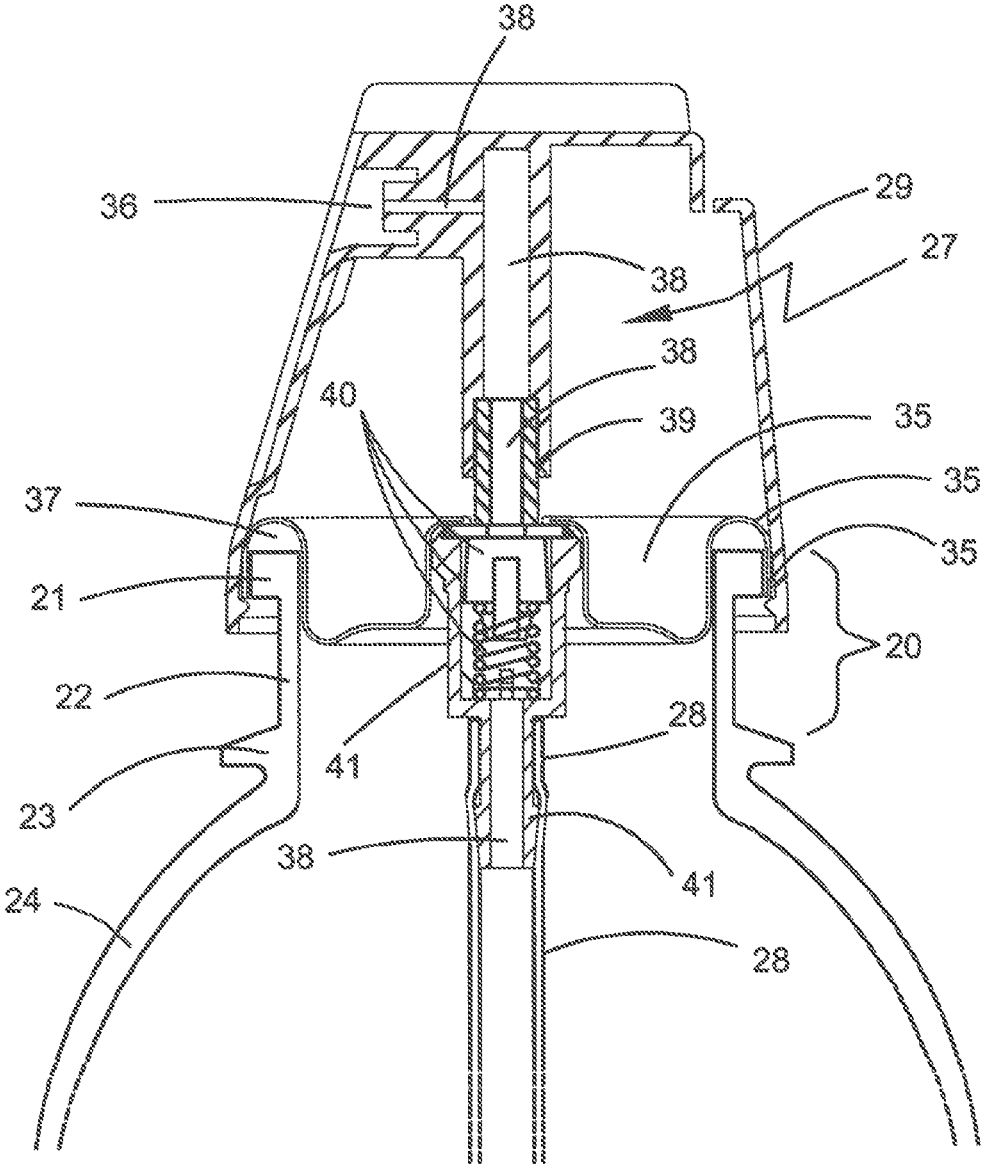
FIG. 9 is an enlarged fragmentary cross-sectional view of a plastic aerosol container, according to an embodiment of the invention.

As set forth in FIGS. 1, 2 and 8, the plastic aerosol container 10 comprises a neck 20, a support ring 23, a shoulder 24, a cylindrical body 25, a base 26, a dispensing valve 27 and a cap 29. As shown in FIG. 2, the neck 20 further includes a lip 21 and a lip cavity 22. The support ring 23 protrudes below the lip cavity 22 and above the shoulder 24. The shoulder 24 supports the neck 20 and aides in preventing deformation of the container 10. As shown in FIGS. 4 and 5, the base 26 further includes legs 30. As shown in FIG. 9, the dispensing valve 27 is placed atop the neck 20 and sealed thereto. The cap 29 is placed atop the valve 27 and functions as an actuator to release the contents of the container 10.

The container 10 may be made of any thermoplastic material, such as high density polyethylene (HDPE), low density polyethylene (LDPE) and polyethylene terepthalate (PET). The material may be transparent, opaque or partially opaque. According to a first embodiment, the container 10 is comprised of zero percent permeability amorphous PET. While this Description refers to PET, it is understood that any viable thermoplastic material may be used. Plastics, such as PET, do not leave metal oxides on surfaces as metal containers do. Further, plastics, such as PET, do not react with chemicals such as LPG, Kerosene, Naptha, alcohol, acetone, and other chemicals commonly found in aerosol sprays. Finally, plastics, such as PET, are desirable because they are inexpensive, recyclable and more environmentally friendly than other materials.

The neck 20 is located at the upper end of the container 10. The neck 20 consists of the lip 21 and the lip cavity 22. According to one exemplary embodiment, and by way of example only, the lip 21 is approximately 2.0 mm thick. (For the purpose of this document, the word thick is used to refer to the thickness of a particular portion of the container wall.)

Figure 3:
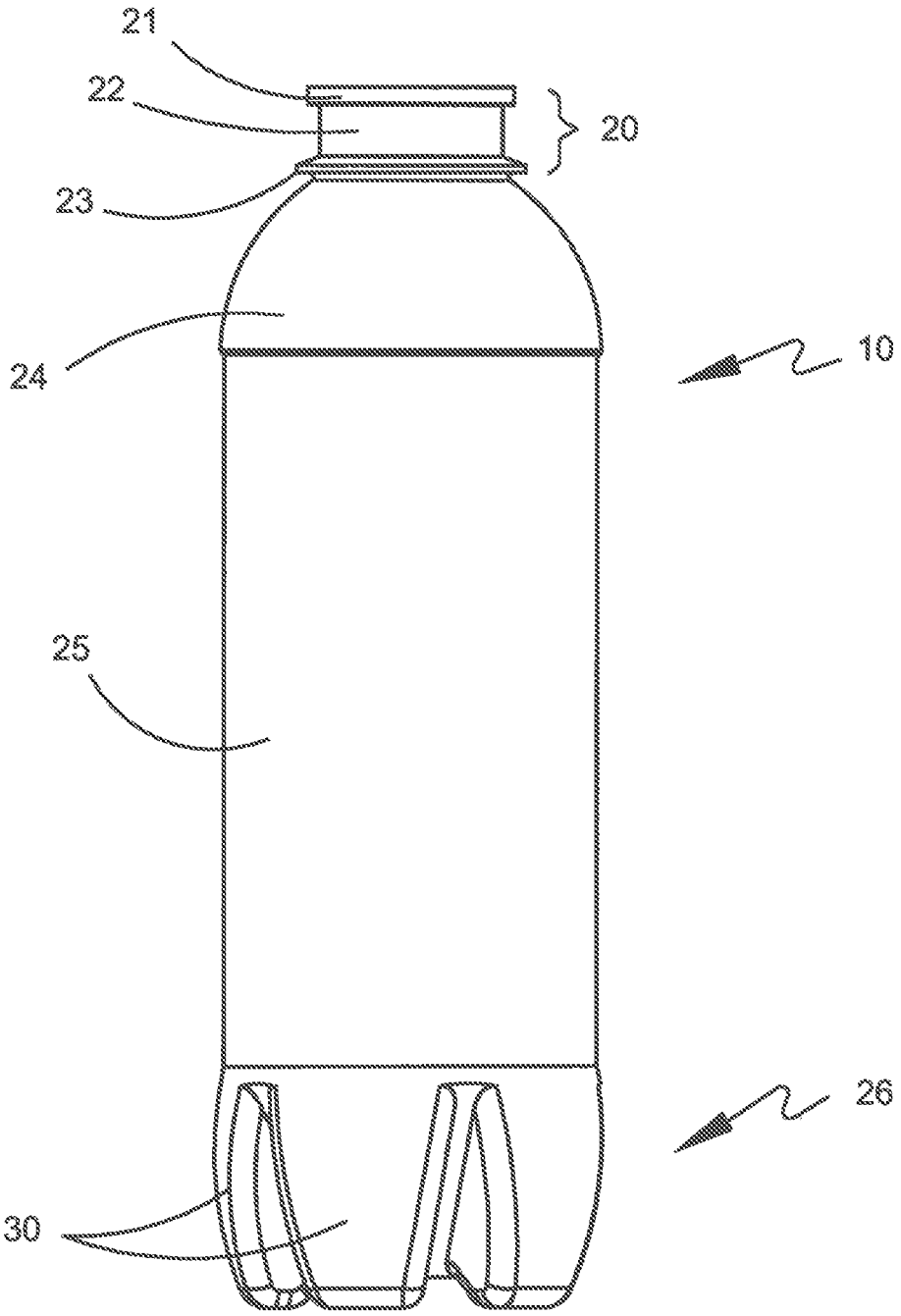
FIG. 3 is a right side view of a plastic aerosol container shown separated from the cap, according to an embodiment of the invention.
Figure 7:
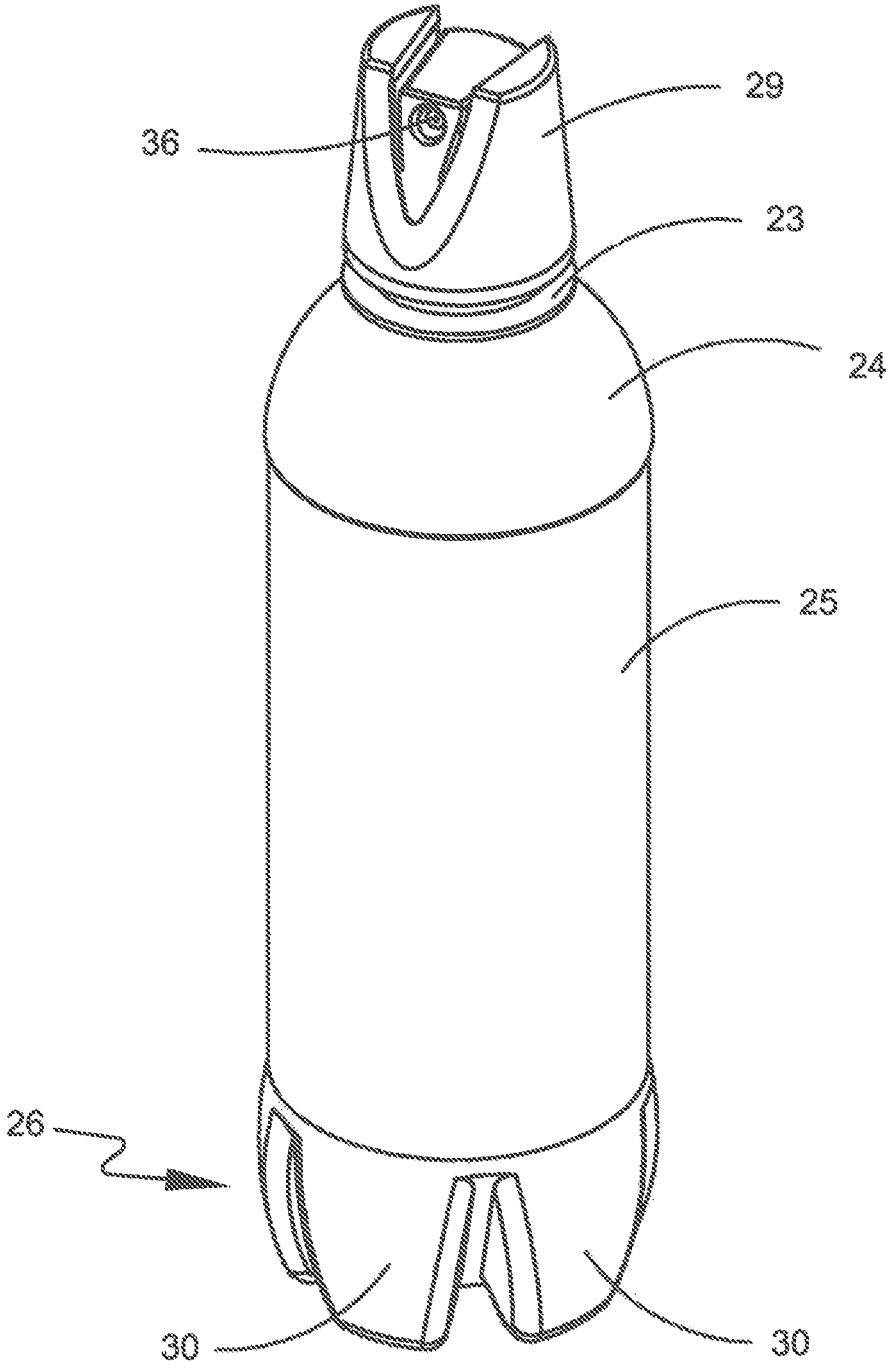
FIG. 7 is a perspective view of a plastic aerosol container, according to an embodiment of the invention.

The container includes the support ring 23, shown in FIGS. 2, 3 and 7, which is located at the top of the shoulder 24 to provide additional structural rigidity and strengthening support. According to the previously discussed exemplary embodiment, and by way of example only, the support ring 23 is approximately 4.0 mm thick.

The shoulder 24 is the rounded portion of the container 10 between the neck 20 and the cylindrical body 25. According to the previously discussed exemplary embodiment, and by way of example only, the shoulder 24 is approximately 1.0 mm thick.

The container 10 further comprises the cylindrical body 25. According to some embodiments, the PET that comprises the wall of the cylindrical body 25 is between approximately 0.5 mm and approximately 0.8 mm thick. In a generally cylindrical shape, PET of this thickness has been shown to withstand pressure of up to about 10 bars. According to the previously discussed exemplary embodiment, and by way of example only, the wall of the cylindrical body 25 is approximately 0.6 mm thick.

The base 26 consists of three or more legs 30 and a central injection point 31. The legs 30 are protruded from the base 26 as shown in FIGS. 2 and 3. The legs 30 begin at or near an internal circle 32 and extend radially outward to approximately the outer diameter of the base 26. According to one embodiment, and as shown in FIGS. 4 and 5, the preferred number of legs 30 is five. The central injection point 31 is located in the center of the internal circle 32 of the base 26. According to the previously discussed exemplary embodiment, and by way of example only, the walls of the base 26 are approximately 1.0 mm thick.

Figure 10:
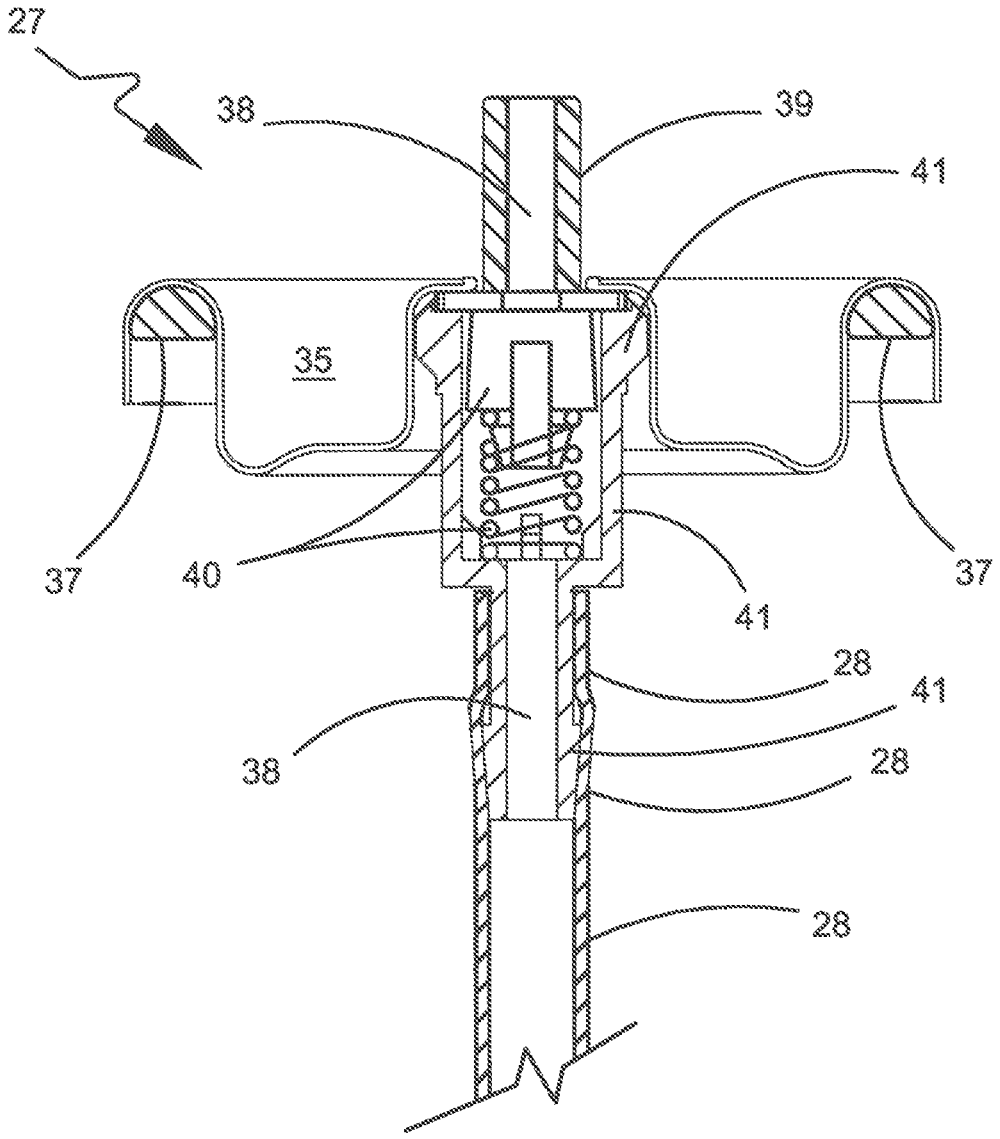
FIG. 10 is a cross-sectional view of a dispensing valve, according to an embodiment of the invention.

The dispensing valve 27 may be any piece or pieces capable of releasing the components of a pressurized container in a controlled manner, as known in the art of aerosol containers. As shown in FIGS. 9 and 10, and by way of example only, the dispensing valve 27 includes an outer flange 35, a nozzle 39, a mechanism 40 for opening and closing a passageway 38, a housing 41 for enclosing the mechanism 40, and a stem 28. The outer flange 35 is formed of a malleable material which is shaped to fit about the lip 21 and the lip cavity 22 by being compressed therearound. The nozzle 39 is located in the center of the outer flange 35 and protrudes vertically therefrom. Depressing or otherwise changing the position of the nozzle 39 activates the mechanism 40 for opening and closing the passageway 38. The mechanism 40 may be any mechanism for opening and/or closing a passageway, as known in the art of aerosol containers, and may consist of one part or multiple parts. The mechanism 40 is surrounded, in whole or in part, by the housing 41. The stem 28 is secured to the housing 41 by any suitable means. The nozzle 39, the mechanism 40, the housing 41 and the stem 28 form a passageway 38 extending from the bottom of the container 10 to the cap 29. The passageway 38 is generally in a closed position, but may be opened using the mechanism 40. When the passageway 38 is in an open position, the stem 28 transports the contents of the container 10 from the bottom of the container 10 to an exit point 36 in the cap 29.

As shown in FIGS. 8 and 9, the dispensing valve 27 is secured across the opening of the container 10 by fitting the outer flange 35 over the lip 21. The flange 35 is crimped or compressed to the lip 21 and/or lip cavity 22 from the inside, the outside, or both, to seal the container 10.

According to yet another embodiment, and as shown in FIG. 9, the dispensing valve 27 further includes a seal 37, formed of rubber or any other material capable of functioning as a seal, to be positioned intermediate the neck 20 of the container 10 and the outer flange 35 of the dispensing valve 27, to prevent leakage of the product.

Figure 6:
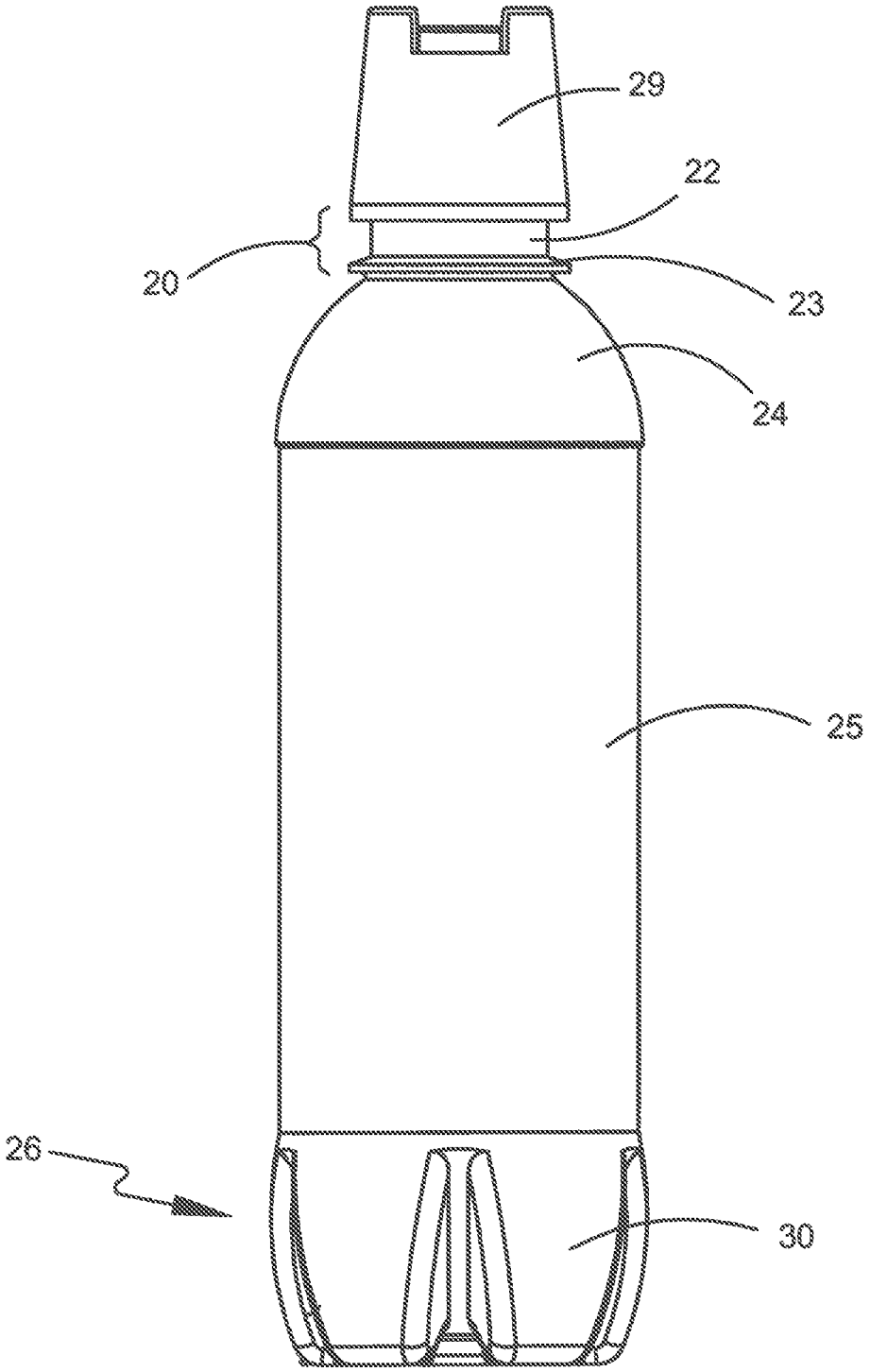
FIG. 6 is a back view of a plastic aerosol container, according to an embodiment of the invention.

The cap 29, which may be any depressible head piece, is secured atop the container 10 as shown in FIG. 6. As shown in FIG. 9, the cap 29 serves to actuate the nozzle 39 of the dispensing valve 27 and cause the release of product.

The container 10 may be of any shape or size, so long as the dimensions are appropriate to resist deformation at high pressures, such as those present within an aerosol container. Appropriate dimensions of container 10 may be determined using the following equation:

$$\sigma = P*D/2t$$

Wherein sigma, shown as σ, is the stress placed on the material, "P" is the internal pressure, "D" is the inner diameter of the container, and "t" is the thickness of the container at its thinnest point. According to another embodiment, and by way of example only, the inner diameter of the container 10, as measured from the inside walls of the cylindrical body, is 5.08 cm; the wall of the cylindrical body is 0.0355 cm thick; and the pressure within the container is 9.843 kg/cm.sup.2 (approximately 9.65 bars). Accordingly, the stress placed on the material is 703.1 kg/cm2. So long as the stress placed on the material is less than the yield strength of the material, no defamation or failure will occur. A person of ordinary skill in the art will understand that yield strength indicates the stress at which a material will begin to deform. The yield strength of a material may be determined using one of many available references, or by communicating with the supplier of the material.

At least one embodiment of the plastic aerosol container 10 was found to resist deformation at pressures up to around 12 bars, while the traditional steel and aluminum cans deformed at pressures of approximately 8 bars. Further, the embodiment burst at a pressure of approximately 15 bars, while the traditional steel or aluminum can burst at pressures of approximately 10 bars.

In order to prevent creep, portions of the neck 20 may be approximately 1.5 to approximately 2 times thicker than the cylindrical body 25 of the container 10. The support ring 23, which is located above the shoulder 24, provides additional support in an area near the shoulder 24, which is subject to very high pressure.

The above described embodiment is more safe than presently available aerosol containers. The explosion of a plastic container 10, of the type described herein, will cause only the valve 27 and cap 29 portions to separate from the rest of the container 10. This is significantly less dangerous than the traditional steel and aluminum containers which have been known to explode into multiple sharp pieces.

The method of manufacturing the container 10 consists primarily of two steps. The first step is preform injection molding. Using this process, the neck 20 of the container 10, including the lip 21, the lip cavity 22 and the support ring 23, are formed. Step two is blow molding, which is used to create the remainder of the container 10. Using this process, the remainder of the container 10, including the shoulders 24, the cylindrical body 25 and the base 26, are formed. According to one embodiment, stretch blow molding was used, however any method of blow molding is within the inventive concept. According to one embodiment, the resulting container 10 is a crystalline PET container.

After the container 10 is formed, the product, most likely a liquid, is introduced into the container 10. The container 10 is then sealed by placing the dispensing valve 27 atop the lip 21 and compressing the outer flange 35 of the dispensing valve 27 to the inside and/or the outside of the lip cavity 22. After the container 10 is completely sealed, the propellant is introduced into the container 10 under high pressure through the central injection point 31 in the base 26. Alternatively, the propellant may be introduced into the container through the dispensing valve 27, after the dispensing valve 27 is sealed around the lip 21 of the container 10. The internal pressure of the container 10 is between approximately 40 psi and approximate 90 psi when filled.

The container 10 described herein is designed to withstand pressures of approximately 120 psi at temperatures of approximately 55 degrees Celsius.

While the invention has been described with reference to an embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

The invention claimed is:

1. A plastic aerosol container, comprising:

a cylindrical body extending about a longitudinal axis;

a shoulder having a top end and a bottom end, wherein the bottom end of the shoulder is connected to a proximal end of the cylindrical body, wherein the shoulder has a arcuate cross-sectional shape in which the outside diameter of the shoulder decreases continuously from the bottom end to the top end, and wherein the top end of the shoulder has a first material thickness in a plane transverse to the longitudinal axis of the cylindrical body; and a neck connected to the top end of the shoulder and extending longitudinally therefrom, the neck having a substantially planar inner surface, wherein the neck further comprises:

a support ring, wherein the support ring is positioned adjacent the top end of the shoulder and extends substantially transverse to the longitudinal axis to overlie a portion of the shoulder, and wherein the support ring has a second material thickness extending from the inner surface of the neck to a support ring outer edge in a plane transverse to the longitudinal axis of the cylindrical body that is greater than the first material thickness;

a lip positioned at a proximal end of the neck and extending substantially transverse to the longitudinal axis to position a lower surface of the lip in overlying relationship to a top surface of the support ring, wherein the lip has a third material thickness extending from the inner surface to a lip outer edge in a plane transverse to the longitudinal axis of the cylindrical body that is greater than the first material thickness and less than the second material thickness; and a lip cavity defined between the lower surface of the lip and the top surface of the support ring.

2. The plastic aerosol container of claim 1, further comprising a base connected to a distal end of the cylindrical body, wherein the base further includes three or more legs.

3. The plastic aerosol container of claim 2, wherein the neck, the support ring, the shoulder, the cylindrical body and the base are integrally formed from a thermoplastic material.

4. The plastic aerosol container of claim 3, wherein the neck, the support ring, the shoulder, the cylindrical body and the base are made of crystalline polyethylene terepthalate.

5. The plastic aerosol container of claim 3, wherein the neck, the support ring, the shoulder, the cylindrical body and the base are made of low density polyethylene.

6. The plastic aerosol container of claim 3, wherein the neck, the support ring, the shoulder, the cylindrical body and the base are made of high density polyethylene.

7. The plastic aerosol container of claim 2, further comprising a dispensing valve and a cap.

8. The plastic aerosol container of claim 7, wherein the dispensing valve further comprises:

a nozzle;

an outer flange;

a mechanism for opening a passageway;

a housing for enclosing the mechanism; and a stem.

9. The plastic aerosol container of claim 8, wherein the dispensing valve further comprises a seal.

10. The plastic aerosol container of claim 8, wherein the outer flange is affixed to the lip of the container.

11. The plastic aerosol container of claim 2, wherein the container has five legs.

12. The plastic aerosol container of claim 2, wherein the base further comprises central injection point.

13. The plastic aerosol container of claim 7, wherein the cap comprises a depressible portion that functions as an actuator to release the contents of the container.

14. The plastic aerosol container of claim 1, wherein:

the third material thickness of the lip is approximately 2 millimeters thick;

the second material thickness of the supporting ring is approximately 4 millimeters thick;

the cylindrical body is approximately 0.5 to approximately 0.8 millimeters thick; and the base is approximately 1 millimeter thick.

15. The plastic aerosol container of claim 14, wherein the cylindrical body is approximately 0.6 millimeters thick.

16. The plastic aerosol container of claim 7, further comprising a product and a propellant.

17. The plastic aerosol container of claim 1, wherein the support ring has a bottom surface opposing the top surface, wherein the bottom surface is substantially transverse to the longitudinal axis, and wherein the top surface tapers upwardly toward the lip of the neck.

18. The plastic aerosol container of claim 17, wherein the portion of the neck between the bottom surface of the support ring and the top end of the shoulder is thicker than the thickness of the lip cavity.

19. The plastic aerosol container of claim 16, wherein the thickness of the wall of the cylindrical body is equivalent to the internal pressure multiplied by the inner diameter of the container and divided by an acceptable amount of stress to be placed the thermoplastic material.

20. The plastic aerosol container of claim 19, wherein the acceptable amount of stress is less than the yield strength of the thermoplastic material.

21. The plastic aerosol container of claim 19, wherein portions of the neck are approximately 1.5 to approximately 2.0 times thicker than the thickness of the wall of the cylindrical body.

22. The plastic aerosol container of claim 1, wherein the first material thickness of the top end of the shoulder is about half the thickness of the lip.

23. The plastic aerosol container of claim 22, wherein the third material thickness of the lip is about half the thickness of the support ring.

24. The plastic aerosol container of claim 1, wherein the material thickness of the lip cavity is substantially uniform.

* * * * *